US005862680A

United States Patent [19]

Higginbotham et al.

[11] Patent Number: 5,862,680

[45] Date of Patent: Jan. 26, 1999

[54] AIR SEPARATION

[75] Inventors: Paul Higginbotham, Guildford; John Douglas Oakey, Godalming, both of England

[73] Assignee: The BOC Group plc, Windlesham Surrey, England

[21] Appl. No.: 925,810

[22] Filed: Sep. 5, 1997

[30] Foreign Application Priority Data

Sep. 5, 1996 [GB] United Kingdom ..... 9618577

[51] Int. Cl.[6] ..... F25J 3/00

[52] U.S. Cl. ..... 62/654; 62/924

[58] Field of Search ..... 62/654, 924

[56] References Cited

U.S. PATENT DOCUMENTS 5,341,647 8/1994 Koeberle et al. ..... 62/654
5,428,962 7/1995 Rieth ..... 62/653
5,471,842 12/1995 Mostello et al. ..... 62/653

*Primary Examiner*—Ronald Capossela
*Attorney, Agent, or Firm*—David M. Rosenblum; Salvatore P. Pace

[57] ABSTRACT

Air is separated in an arrangement of rectification columns comprising a double rectification column having a higher pressure column and a lower pressure rectification column, an intermediate pressure rectification column, and a side rectification column communicating with the lower pressure column. The side rectification column is provided with a condenser and the intermediate pressure rectification column with a reboiler and a further condenser. A stream of oxygen-enriched liquid is withdrawn from the bottom of the higher pressure column through an outlet and is separated in the intermediate pressure rectification column. The reboiler is heated by a stream typically withdrawn from the side rectification column through an outlet thereof. The condensers of the side rectification column and the intermediate column are cooled by streams having different oxygen mole fractions.

18 Claims, 3 Drawing Sheets

AIR SEPARATION

BACKGROUND OF THE INVENTION

This invention relates to a method and plant for separating air.

The most important method commercially for separating air is by rectification. In such a method there are typically performed steps of compressing and purifying the air, fractionating the compressed, purified, air in a higher pressure rectification column, condensing nitrogen vapour separated in the higher pressure rectification column, employing a first stream of resulting condensate as reflux in the higher pressure rectification column, and a second stream of the resulting condensate as reflux in a lower pressure rectification column, withdrawing an oxygen-enriched liquid air stream from the higher pressure rectification column, introducing an oxygen-enriched vaporous air stream into the lower pressure rectification column, and separating the oxygen-enriched vaporous air stream therein into oxygen-rich and nitrogen-rich fractions. The condensation of nitrogen is effected by indirect heat exchange with boiling oxygen-rich liquid fraction in the bottom of the lower pressure rectification column.

The purification of the air is performed so as to remove impurities of relatively low volatility, particularly water vapour and carbon dioxide. If desired, hydrocarbons may also be removed.

At least a part of the oxygen-enriched liquid air which is withdrawn from the higher pressure rectification column is typically partially or completely vaporised so as to form the vaporous oxygen-enriched air stream which is introduced into the lower pressure rectification column.

A local maximum concentration of argon is created at an intermediate level of the lower pressure rectification column beneath the level at which the vaporous oxygen-enriched air stream is introduced. If it is desired to produce an argon product, a stream of argon-enriched oxygen vapour is taken from a vicinity of the lower pressure rectification column below the oxygen-enriched vaporous air inlet where argon concentration is typically in the range of 5 to 15% by volume, and is introduced into a bottom region of the side rectification column in which an argon product is separated therefrom. The side column has a condenser at its head from which a reflux flow for the side column can be taken. The condenser is cooled by a part or all of the oxygen-enriched liquid air withdrawn from the higher pressure rectification column, the oxygen-enriched liquid air thereby being vaporised. Such a process is illustrated in EP-A-377 117.

The rectification columns are sometimes required to separate a second liquid feed air stream in addition to the first vaporous feed air stream. Such a second liquid air stream is used when an oxygen product is withdrawn from a lower pressure rectification column in liquid state, is pressurised, and is vaporised by heat exchange with incoming air so as to form an elevated pressure oxygen product in gaseous state. A liquid air feed is also typically employed in the event that one or both the oxygen and nitrogen products of the lower pressure rectification column are taken at least in part in liquid state. Employing a liquid air feed stream tends to reduce the amount of liquid nitrogen reflux available to the rectification, particularly, for example, if a liquid nitrogen product is taken. If an argon product is produced there is typically a need for enhanced reflux in the lower pressure rectification column in order to achieve a high argon recovery. The relative amount of liquid nitrogen reflux may also be reduced by introducing vaporous feed air into the lower pressure rectification column (in which example nitrogen cannot be separated from this air in the higher pressure rectification column and is therefore not available for condensation) or by withdrawing a gaseous nitrogen product from the higher pressure rectification column, not only when liquid products are produced but also when all the oxygen and nitrogen products are withdrawn in gaseous state from the rectification columns. There may therefore be a difficulty in obtaining a high argon recovery in, for example, any of the circumstances outlined above, particularly if a liquid nitrogen or liquid oxygen product is produced. Accordingly, it may be necessary, for example, to sacrifice either production or purity of liquid products (including liquid product streams that are vaporised downstream of their exit from the rectification columns) and any gaseous nitrogen product that is taken from the higher pressure rectification column or recovery of argon.

SUMMARY OF THE INVENTION

According to the present invention there is provided a method of separating air comprising separating in a double rectification column, comprising a higher pressure rectification column and a lower pressure rectification column, a flow of compressed vaporous feed air into an oxygen-rich fraction and a nitrogen-rich fraction, and separating in a side rectification column a vaporous argon fraction from an argon-containing oxygen vapour stream withdrawn from a first intermediate region of the lower pressure rectification column, wherein a first oxygen-enriched liquid air stream taken from the double rectification column is separated in an intermediate pressure rectification column at pressures between the lowest pressure that obtains in the higher pressure rectification column and the highest pressure that obtains in the lower pressure rectification column, thereby forming a bottom liquid air fraction enriched in oxygen and a top vapour depleted of oxygen; a flow of the vaporous argon fraction is condensed in heat exchange with a second oxygen-enriched liquid air stream, thereby forming a first oxygen-enriched vapour; a flow of the oxygen-depleted vapour is condensed in heat exchange with at least one third liquid air stream, at least one of which is oxygen-enriched, thereby forming a second oxygen-enriched vapour; a stream of the first oxygen-enriched vapour is introduced into one of a second and a third intermediate region of the lower pressure rectification column; a stream of the second oxygen-enriched vapour is introduced into the other of the second and third intermediate region of the lower pressure rectification column, the second intermediate region having a higher mole fraction of oxygen in the vapour phase than the third intermediate region but a lower mole fraction of oxygen in the vapour phase than the first intermediate region; the intermediate pressure rectification column is reboiled by vapour withdrawn from one or both of the side rectification column and a section of the lower pressure rectification column extending from first intermediate region to the second intermediate region thereof; the mean oxygen mole fraction of the said third liquid air stream is different from the oxygen mole fraction of the second oxygen-enriched liquid air stream, and at least some of the said third liquid air stream is taken from the bottom oxygen-enriched liquid air fraction, a liquid air feed, the higher pressure rectification column or the lower pressure rectification column.

The invention also provides apparatus for separating air comprising a double rectification column, which itself comprises a higher pressure rectification column and a lower pressure rectification column, for separating a flow of compressed vaporous feed air into an oxygen-rich fraction and a nitrogen-rich fraction, and a side rectification column for separating an argon fraction from an argon-containing oxygen vapour stream withdrawn through an intermediate outlet from a first intermediate region of the lower pressure rectification column, wherein the double rectification column has an outlet for a stream of a first liquid air fraction enriched in oxygen; the apparatus additionally includes (i) an intermediate pressure rectification column for separating a stream of the first oxygen-enriched liquid air fraction at pressures between the lowest pressure that, in use, obtains in the higher pressure rectification column and the highest pressure that obtains, in use, in the lower pressure rectification column, whereby, in use, a bottom liquid air fraction enriched in oxygen and a vapour depleted of oxygen are formed, (ii) a first condenser for condensing argon vapour separated, in use, in the side rectification column, the first condenser having vaporising passages communicating with a source of a second oxygen-enriched liquid air stream and with one of a second intermediate region and a third intermediate region of the lower pressure rectification column, the mole fraction of oxygen in the vapour phase in the second intermediate region being, in use, greater than the mole fraction of oxygen in the vapour phase in the third intermediate region but less than the mole fraction of oxygen in the vapour phase in the first intermediate region, (iii) a second condenser for condensing a flow of the oxygen-depleted vapour having vaporising passages communicating with at least one source of at least one third liquid air stream and with the other of the second intermediate region and the third intermediate region, at least one said source being oxygen-enriched, whereby, in use, the mean oxygen mole fraction of the said third liquid air stream is different from the oxygen mole fraction of the second liquid air stream enriched in oxygen, and (iv) a reboiler associated with the intermediate pressure rectification column having condensing passages communicating with an outlet from a section of the lower pressure rectification column extending from said first intermediate region to said second intermediate region and/or with an outlet from the side rectification column, and the said source of the third liquid air stream comprises one or more of a bottom region of the intermediate pressure rectification column where, in use, the bottom oxygen-enriched liquid air fraction collects, the higher pressure rectification column, the lower pressure rectification column, and a source of liquefied feed air.

The method and apparatus according to the invention make it possible in comparison with a comparable method and apparatus to reduce the specific power consumption, to increase the argon yield, and to increase the yield of the oxygen-rich fraction. In addition, if liquid products are produced, the ratio of liquid oxygen and/or liquid nitrogen product to the total production of oxygen product may be increased.

There are a number of different factors which contribute to this advantage. First, the intermediate pressure rectification column enhances the rate at which liquid reflux can be made available to the lower pressure rectification column (in comparison with the method according to EP-A-0 377 117) and thereby makes it possible to ameliorate the problem identified above. Thus a stream of the condensed oxygen-depleted vapour is preferably introduced into the lower pressure rectification column. Alternatively, or in addition, a stream of the condensed oxygen-depleted vapour may be taken as product, particularly if it contains less than one per cent by volume of oxygen. Secondly, the "pinch" at the second intermediate region of the lower pressure rectification column can be arranged to be at a higher oxygen concentration than the equivalent point in a comparable conventional process in which the intermediate pressure rectification column is omitted. Accordingly, the liquid-vapour ratio in the section of the lower pressure rectification column extending from the first intermediate region to the second intermediate region can be made greater than in the conventional process. Therefore, the feed rate to the side column can be increased. It is thus possible to reduce the concentration of argon in the vapour feed to the side column (in comparison with the comparable conventional process) without reducing argon recovery. A consequence of this is that the lower pressure rectification column needs less reboil to achieve a given argon recovery. Thus, for example, the rate of production or the purity of a liquid oxygen product from the lower pressure rectification column or the rate of production of a gaseous nitrogen product from the higher pressure rectification column may be enhanced. In another example, the rate of production and purity of the oxygen product or products may be maintained, but the rate of which vaporous air is fed from an expansion turbine into the lower pressure rectification column may be increased, thereby making possible an overall reduction in the power consumed.

Further possibilities for optimising the method and apparatus according to the invention are made possible by virtue of the fact that the composition of the liquid which condenses the oxygen-depleted vapour is different from that of the liquid which condenses the argon. As a result, matching temperature differences can be achieved in the first and second condensers. This helps to keep down the total size of these two condensers, and also facilitates operation of the intermediate pressure rectification column with a high vapour loading.

Preferably, the second liquid air stream enriched in oxygen has a higher mole fraction of oxygen concentration than the mean oxygen mole fraction of the third liquid air stream. In such examples, the first oxygen-enriched vapour flows to the second intermediate region of the lower pressure rectification column and the second oxygen-enriched vapour flows to the third intermediate region of the lower pressure rectification column.

Preferably, a vapour stream taken from an intermediate region of the side rectification column, typically 5 to 10 theoretical stages from the bottom of the side column, is employed to effect the reboiling of the intermediate pressure rectification column. As a result, the side column may be arranged to operate at a relatively low reflux ratio above the location from which the stream for reboiling the intermediate pressure rectification column is taken. (More theoretical trays are thus required in the side column than would otherwise be necessary. However, in comparison with a comparable conventional plant, if random or structured packings are employed to effect liquid-vapour contact in the side column, the overall amount of packing required is not substantially increased, since the diameter of the side column may be reduced.) As a further result, a greater rate of condensation within the reboiler associated with the bottom of the intermediate pressure rectification column can be achieved. This has the effect, therefore, of increasing the load on the intermediate pressure rectification column and thereby enables yet further enhancement in the liquid nitrogen production or argon recovery to be achieved. The term "mean oxygen mole fraction" means the mole fraction of oxygen in the third liquid air stream if there is just one such stream, or the mole fraction of oxygen in the stream that is or would be formed by mixing the third liquid air streams if there is more than one such stream.

The term "rectification column", as used herein, means a distillation or fractionation column, zone or zones, wherein liquid and vapour phases are countercurrently contacted to effect separation of a fluid mixture, as for example, by contacting the vapour and liquid phases on packing elements or a series of vertically spaced trays or plates mounted within the column, zone or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel may typically have a height of over 50 meters. It is therefore obviously desirable to construct the argon rectification column in two separate vessels so as to avoid having to employ a single, exceptionally tall, vessel.

The said third liquid air stream is preferably a single stream of oxygen-enriched liquid air. Preferably, the second stream of oxygen-enriched liquid air comprises a first flow of the bottom oxygen-enriched liquid fraction. Preferably, the said single stream of oxygen-enriched air comprises a mixture of a second flow of the bottom oxygen-enriched liquid air fraction and a flow of an intermediate liquid fraction withdrawn from an intermediate region of the intermediate pressure rectification column.

The second flow of the bottom oxygen-enriched liquid air fraction and the flow of the intermediate liquid fraction are preferably mixed upstream of their heat exchange with the oxygen-depleted vapour. The vapour stream which is employed to reboil the intermediate pressure rectification column is, downstream of the reboiling, preferably returned (in condensed state) to the region from which it is taken.

A flow of liquid feed air may be introduced into any or all of the higher pressure, lower pressure and intermediate pressure rectification columns. It is in some examples preferred to introduce a stream of liquid feed air into the intermediate pressure rectification column so as to keep down the oxygen concentration of the bottom second liquid air fraction which is formed in the intermediate pressure rectification column and thereby maintain an adequate temperature difference in the first condenser.

A stream of the liquid feed air is typically introduced into the intermediate pressure rectification column at the same region as that from which the flow of the intermediate liquid fraction is withdrawn. Alternatively, a stream of liquid air may, if desired, be taken from the higher pressure rectification column and introduced into the same region of the intermediate pressure rectification column as that from which the flow of the intermediate liquid fraction is withdrawn.

Any conventional refrigeration system may be employed to meet the refrigeration requirements of the process and plant according to the invention. Typically, the process and plant according to the invention utilise a refrigeration system comprising two expansion turbines in parallel with one another.

Typically, one of the turbines is a warm turbine, that is to say its inlet temperature is approximately ambient temperature or a little therebelow, say, down to −30° C. and its outlet temperature is in the range of 130 to 180K, and the other turbine is a cold turbine whose inlet temperature typically also in the range of 130 to 180K and whose outlet temperature is typically the saturation temperature of the exiting gas or a temperature not more than 5K above such saturation temperature.

Preferably, both turbines expand a part of the vaporous feed air. The cold turbine preferably has an outlet communicating with a bottom region of the higher pressure rectification column. The warm turbine typically recycles air in heat exchange with streams being cooled to a compressor of incoming air. In another alternative the warm turbine has an outlet communicating with the bottom region of the higher pressure rectification column. In yet another alternative which is preferred, a part of the vaporous feed air is expanded and introduced into the lower pressure rectification column at a fourth intermediate region thereof where the oxygen concentration is lower than in the third intermediate region.

The vaporous air feed to the higher pressure rectification column is preferably taken from a source of compressed air which has been purified by extraction therefrom, of water vapour, carbon dioxide, and, if desired, hydrocarbons and which has been cooled in indirect heat exchange with products of the air separation. The liquefied air feed to the higher pressure rectification column is preferably formed in an analogous manner.

BRIEF DESCRIPTION OF THE DRAWINGS

The method and apparatus according to the present invention will now be described by way of example with reference to the accompanying drawings, in which.

The drawings are not to scale.

DETAILED DESCRIPTION OF THE INVENTION

Figure 1:
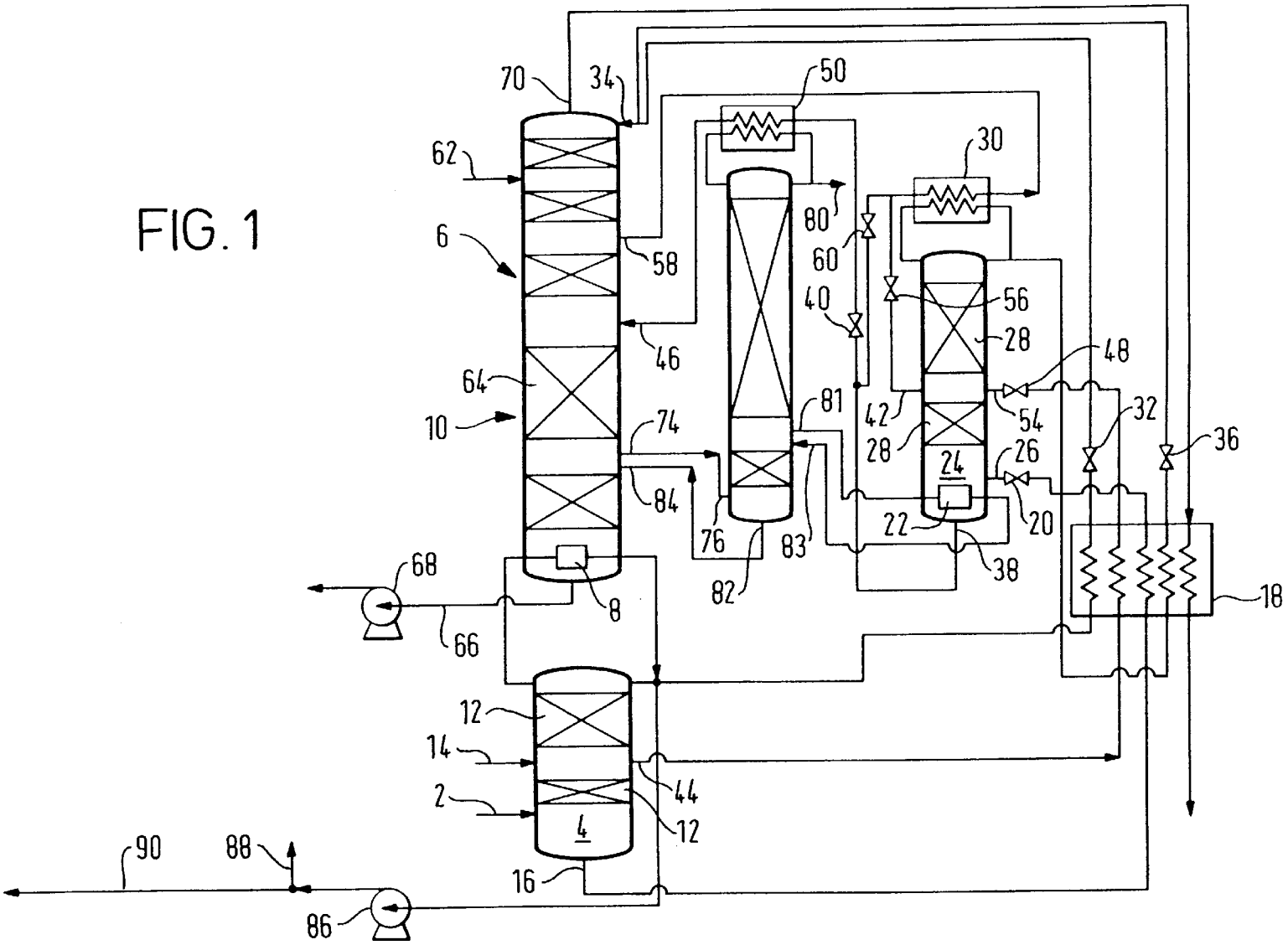
FIG. 1 is a schematic flow diagram of an arrangement of rectification columns forming part of an air separation plant.

Referring to FIG. 1 of the drawings, a first stream or flow of feed vaporous air is introduced through an inlet 2 into a bottom region of a higher pressure rectification column 4, the top of which is thermally linked by a condenser-reboiler 8 to the bottom region of a lower pressure rectification column 6. Together, the higher pressure rectification column 4, the lower pressure rectification column 6, and the condenser-reboiler 8 constitute a double rectification column 10. The higher pressure rectification column 4 contains liquid-vapour contact devices 12 in the form of plates, trays or packings. The devices 12 enable an ascending vapour phase to come into intimate contact with a descending liquid phase such that mass transfer takes place between the two phases. Thus, the ascending vapour is progressively enriched in nitrogen, the most volatile of the three main components (nitrogen, oxygen and argon) of the purified air, the descending liquid is progressively enriched in oxygen, and the least volatile of these three components.

A second compressed, purified, air stream is introduced into the higher pressure rectification column 4 in liquid state through an inlet 14 which is typically located at a level such that the number of trays or plates or the height of packing therebelow corresponds to a few theoretical trays (for example, about 5).

A height of packing or a sufficient number of trays or plates is included in the higher pressure rectification column 4 sufficient for an essentially pure nitrogen vapour to flow out of the top of the column 4 into the condenser-reboiler 8 where it is condensed. A part of the resulting condensate is returned to the higher pressure rectification column 4 as reflux. A stream of a first oxygen-enriched liquid air fraction is withdrawn from the bottom of the higher pressure rectification column 4 through an outlet 16. The oxygen-enriched liquid air stream is sub-cooled by passage through a heat exchanger 18. The sub-cooled, oxygen-enriched, liquid air stream is reduced in pressure by passage through a throttling valve 20. The resulting fluid stream flows into the sump of an intermediate pressure rectification column 24 through an inlet 26. The intermediate pressure rectification column has a reboiler 22 in its sump and includes liquid-vapour contact devices 28 that cause intimate contact between an ascending vapour phase and a descending liquid phase with the result that mass transfer takes place between the two phases. As a result, a second oxygen-enriched liquid air fraction and an oxygen-depleted vapour fraction are formed.

A sufficient height of packing or number of trays or plates is generally included in the intermediate pressure rectification column 24 for the (oxygen-depleted) vapour at the top of the column to be essentially pure nitrogen. This vapour flows into a condenser 30 (hereinafter termed "the second condenser 30") where it is condensed. A part of the condensate is employed as reflux in the intermediate pressure rectification column 24. Another part of the condensate is employed to provide liquid nitrogen reflux for the lower pressure rectification column 6. The condenser-reboiler 8 is also so employed. A stream of the condensate formed in the condenser-reboiler 8 is sub-cooled by passage through the heat exchanger 18, is reduced in pressure by passage through a throttling valve 32, and is introduced into the top of the lower pressure rectification column 6 through an inlet 34. A stream of nitrogen condensate is taken from the second condenser 30, is sub-cooled by passage through the heat exchanger 18, and is reduced in pressure by passage through a throttling valve 36. The resulting pressure-reduced liquid nitrogen is mixed with that introduced into the lower pressure column 6 through the inlet 34, the mixing taking place downstream of the throttling valve 32.

The reboiler 22 forms an ascending vapour stream in operation of the intermediate pressure rectification column 24 by reboiling some of the liquid at the bottom of the column 24. The second oxygen-enriched liquid air fraction has an oxygen concentration greater than that of the first oxygen-enriched liquid air. This is because the partial reboiling in the reboiler 22 enriches the liquid in oxygen. Further enriched liquid (i.e. second oxygen-enriched liquid air fraction) is withdrawn from the intermediate pressure rectification column 24 through an outlet 38. A first flow of the further-enriched liquid stream passes through a throttling valve 40. The resulting liquid air stream passes through condenser 50 (hereinafter termed "the first condenser 50") which is associated with the top of a side column 52 in which an argon-oxygen stream withdrawn from the lower pressure rectification column 6 is separated. (The concentration of argon in the argon-oxygen stream is greater than the normal concentration of argon in air.)

The first flow of further-enriched liquid is essentially entirely vaporised in the condenser 50. The resulting stream (termed "the first stream of oxygen-enriched vapour") is introduced into the lower pressure rectification column 6 through an inlet 46 at what shall be referred to below as the second intermediate region of the lower pressure rectification column 6.

A stream of an intermediate liquid air fraction is withdrawn from the intermediate pressure rectification column 24 through an outlet 42 at an intermediate region thereof. A stream of a further intermediate liquid air fraction is withdrawn through an outlet 44 from the same level of the higher pressure rectification column 4 as that at which the inlet 14 is located, and is passed through the heat exchanger 18, thereby being sub-cooled. The resulting sub-cooled liquid air stream flows through a throttling valve 48, thereby being reduced in pressure, and is introduced into the intermediate pressure rectification column 24 through an inlet 54 which is at the same level as the outlet 42. The stream of the intermediate liquid air fraction flows from the intermediate pressure rectification column through a pressure reducing or expansion valve 56 and is mixed with a second flow of the further enriched liquid downstream of another expansion valve 60 through which the further enriched liquid is passed. The resulting stream of oxygen-enriched liquid air is employed to provide refrigeration to the second condenser 30, passing through boiling passages (not shown) thereof, thus effecting condensation of nitrogen vapour therein, and as a result being at least partially and preferably essentially entirely reboiled. The resulting vapour ("the second stream of oxygen-enriched vapour") flows from the second condenser 30 and is introduced into the lower pressure rectification column 6 through an inlet 58 located at an intermediate region ("the third intermediate region") of the lower pressure rectification column 6. Typically, a flow of vaporous feed air (not enriched in or depleted of oxygen) is introduced into the lower pressure rectification column 6 through an inlet 62 at a level below that of the inlet 34 but above that of the inlet 58. Alternatively, this flow of vaporous feed air may be premixed with the second stream of oxygen-enriched vapour.

The various streams containing oxygen and nitrogen that are introduced into the lower pressure rectification column 6 are separated therein to form, in its sump, oxygen, preferably containing less than 0.5% by volume of impurities, (more preferably less than 0.1% of impurities) and a nitrogen product at its top containing less than 0.1% by volume of impurities. The separation is effected by contact of an ascending vapour phase with descending liquid on liquid-vapour contact devices 64, which are preferably packing (typically structured packing), but which alternatively can be provided by trays or plates. The ascending vapour is created by boiling liquid oxygen in the boiling passages (not shown) of the reboiler-condenser 8 in indirect heat exchange with condensing nitrogen. An oxygen product in liquid state is withdrawn from the bottom of the rectification column through an outlet 66 by a pump 68. Additionally, an oxygen product may be withdrawn in vapour state through another outlet (not shown). A gaseous nitrogen product is withdrawn from the top of the rectification column 6 through an outlet 70 and is passed through the heat exchanger 18 in counter-current heat exchange with the streams being sub-cooled.

A local maximum of argon is created in a section of the lower pressure rectification column 6 extending from an outlet 74 (which is located at an intermediate region of the column 6, referred to below as the first intermediate region to the intermediate inlet 46. An argon-enriched vapour stream is withdrawn through the outlet 74 and is fed into the bottom of the side rectification column 52 through an inlet 76. An argon product is separated from the argon-enriched oxygen vapour stream, which stream typically contains from 6 to 14% by volume of argon, in the side column 52. The column 52 contains liquid-vapour contact devices 78 in order to effect intimate contact, and hence mass transfer, between ascending vapour and descending liquid. The descending liquid is created by operation of the condenser 50 to condense argon taken from the top of the column 52. A part of the condensate is returned to the top of the column 52 as reflux; another part is withdrawn through an outlet 80 as liquid argon product. If the argon product contains more than 1% by volume of oxygen, the liquid-vapour contact devices 78 may comprise structured or random packing, typically a low pressure drop structured packing, or trays or plates in order to effect the separation. If, however, the argon is required to have a lower concentration of oxygen, low pressure drop packing is usually employed so as to ensure that the pressure at the top of the side column 52 is such that the condensing temperature of the argon exceeds the temperature of the fluid which is used to cool the condenser 50. A stream of vaporous mixture of argon and oxygen is withdrawn through an outlet 81 from an intermediate region of the side rectification column 52 from 5 to 10 theoretical stages above the bottom thereof and is used to heat the reboiler 22 associated with the intermediate pressure rectification column 24. The stream of the vaporous mixture is condensed in part or entirely, and is returned to the column 52 through an inlet 83.

An impure liquid oxygen stream is withdrawn from the bottom of the side rectification column 52 through an outlet 82 and is passed through an inlet 84 to the same region of the low pressure rectification column 6 as that from which the argon-enriched oxygen vapour stream is withdrawn through the outlet 74.

If desired, an elevated pressure nitrogen product may be taken from the nitrogen condensed in the reboiler-condenser 8 by means of a pump 86. A part of the elevated pressure liquid nitrogen stream may be taken from a pipe 88 and vaporised, typically in indirect heat exchange with incoming air streams. Another part of the elevated pressure liquid nitrogen stream may be taken via a conduit 90 as a liquid nitrogen product. Similarly, an elevated pressure oxygen gaseous product may be created by vaporisation of part of the liquid oxygen stream withdrawn by the pump 68. The remaining part of the oxygen may be taken as a liquid product.

If desired, some or all of each of the streams that is reduced in pressure by passage through a valve may be sub-cooled upstream of the valve.

In a typical example of the operation of the part of the plant shown in FIG. 1, the lower pressure rectification column 6 operates at a pressure about 1.4 bar at its top; the higher pressure rectification column 4 operates at a pressure about 5.5 bar at its top; the side rectification column 52 operates at a pressure of 1.3 bar at its top; and the intermediate pressure rectification column 24 operates at a pressure of approximately 2.7 bar at its top.

Figure 2:
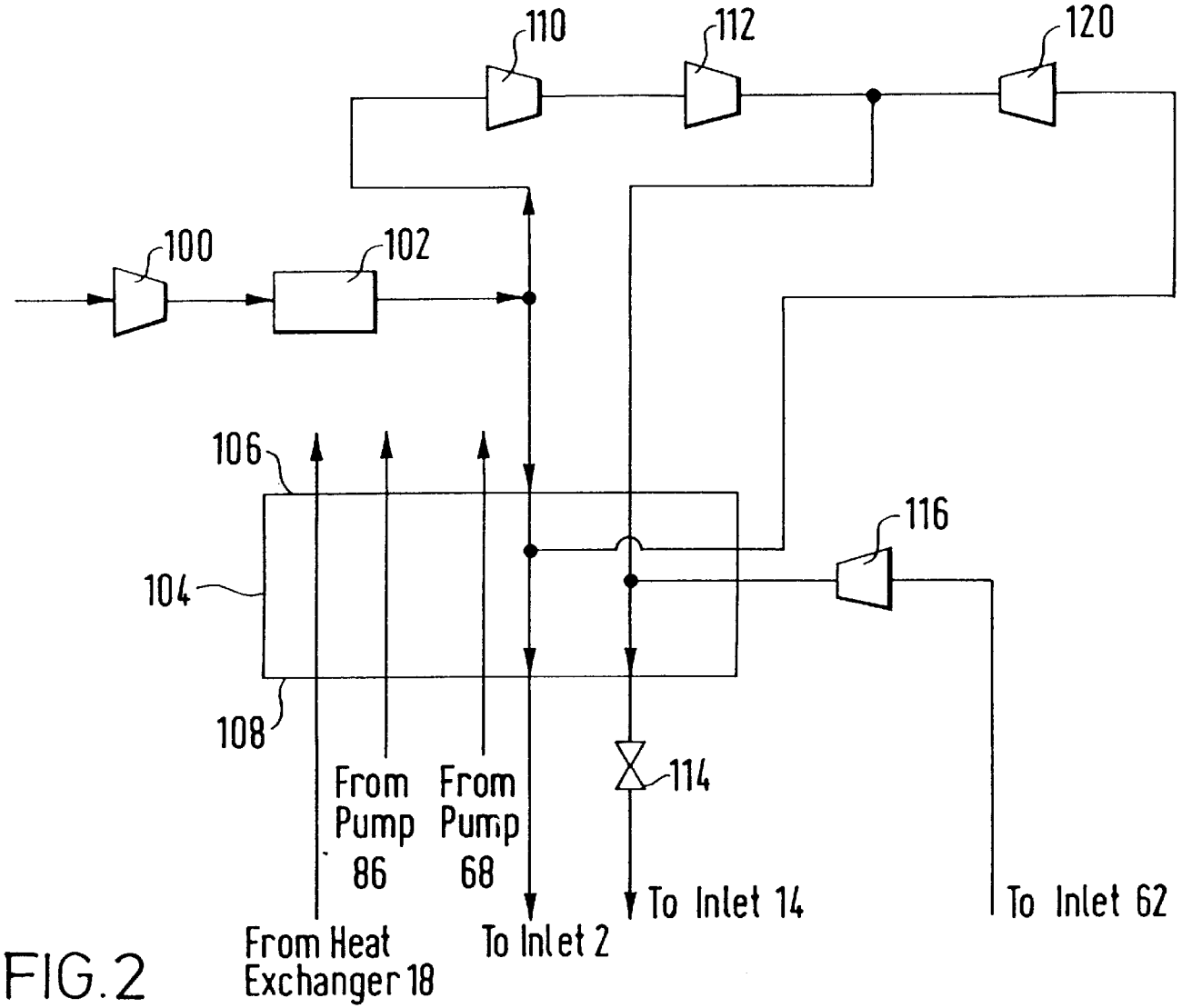
FIG. 2 is a schematic flow diagram of a heat exchanger and associated apparatus for producing the feed streams to that part of the air separation plant which is shown in FIG. 1.

Referring now to FIG. 2 of the accompanying drawings, there is shown another part of the air separation plant which is employed to form the air streams employed in that part of the plant shown in FIG. 1. Referring to FIG. 2, an air stream is compressed in a first compressor 100. The compressor 100 has an aftercooler (not shown) associated therewith so as to remove the heat of compression from the compressed air. Downstream of the compressor 100, the air stream is passed through a purification unit 102 effective to remove water vapour and carbon dioxide therefrom. The unit 102 employs beds (not shown) of adsorbent to effect this removal of water vapour and carbon dioxide. If desired, hydrocarbons may also be removed in the unit 102. The beds of the unit 102 are operated out of sequence with one another such that while one or more beds are purifying the compressed air stream, the remainder are able to be regenerated, for example, by being purged by a stream of hot nitrogen. Such purification units and their operation are well known and need not be described further.

The purified air stream is divided into two subsidiary streams. A first subsidiary stream of purified air flows through a main heat exchanger 104 from its warm end 106 to its cold end 108 and is cooled to approximately its dew point. The resulting cooled vaporous air stream forms a part of the air stream which is introduced into the higher pressure rectification column 4 through the inlet 2 in that part of the plant which is shown in FIG. 1.

Referring again to FIG. 2, the second subsidiary stream of purified compressed air is further compressed in a first booster-compressor 110 having an aftercooler (not shown) associated therewith to remove the heat of compression. The further compressed air stream is compressed yet again in a second booster-compressor 112. It is again cooled in an aftercooler (not shown) to remove heat of compression. Downstream of this aftercooler, one part of the yet further compressed air is passed into the main heat exchanger 104 from its warm end 106. The air flows through the main heat exchanger and is withdrawn from its cold end 108. This air stream is, downstream of the cold end 108, passed through a throttling or pressure reduction valve 114 and exits the valve 114 predominantly in liquid state. This liquid air stream forms the liquid stream which is introduced into the higher pressure rectification column 104 through the inlet 114 (see FIG. 1).

A first expansion turbine 116 is fed with a stream of the yet further compressed air withdrawn from an intermediate location of the main heat exchanger 104. The air is expanded in the turbine 116 with the performance of external work and the resulting air leaves the turbine 116 at approximately its saturation temperature and at the same pressure as that at which the first subsidiary air stream leaves the cold end of the main heat exchanger 104. The air from the expansion turbine 116 is supplied to the inlet 62 to the lower pressure rectification column 6 (see FIG. 1). A further part of the yet further compressed air is taken from upstream of the warm end 106 of the main heat exchanger 104 and is expanded with the performance of external work in a second expansion turbine 120. The air leaves the turbine 120 at a pressure approximately equal to that at the bottom of the higher pressure rectification column 104 and a temperature in the range of 130 to 180K. This air stream is introduced into the first subsidiary stream of air as it passes through the main heat exchanger 104.

A part of each of the liquid oxygen and liquid nitrogen streams pressurised respectively by the pumps 68 and 86 flows through the main heat exchanger 104 countercurrently to the air streams and is vaporised by indirect heat exchange therewith. In addition, the gaseous nitrogen product stream which is taken from the heat exchanger 18 (see FIG. 1) is warmed to ambient temperature by passage through the heat exchanger 104. The pressure of the air stream that is liquefied and the pressures of the liquid nitrogen and the liquid oxygen streams are selected so as to maintain thermodynamically efficient operation of the heat exchanger 104.

Figure 3:
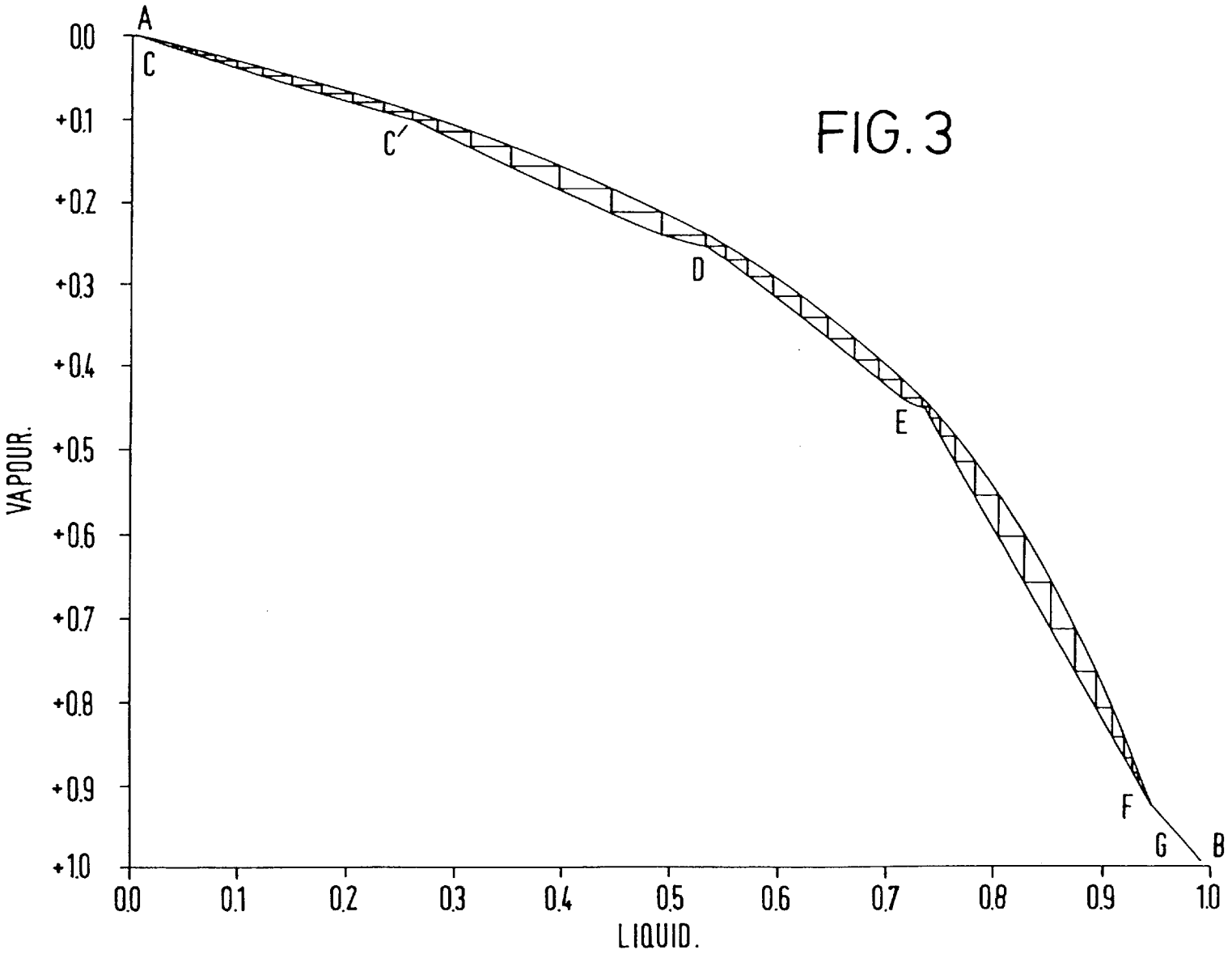
FIG. 3 is a schematic McCabe-Thiele diagram illustrating operation of the lower pressure rectification column shown in FIG. 1 in one example of a process according to the invention.

FIG. 3 illustrates the operation of the lower pressure rectification column 6 shown in FIG. 1 when the vaporous feed air that is introduced into the lower pressure rectification column does not flow through the inlet 62 but is premixed with the second oxygen-enriched vapour. The inlet 62 is instead employed to introduce a stream of liquid air into the lower pressure rectification column 6. This stream of liquid air may form part of the feed air which is liquefied or may be taken from the stream which is withdrawn from the higher pressure rectification column 4 through the outlet 44. The curve AB is the equilibrium line for operation of the lower pressure rectification column 6. The curve CC'DEFG is its operating line. Point F is at the first, Point E is at the second, and Point D is at the third intermediate region of the column 6. (It is the mixture of the second oxygen-enriched vapour and the vaporous feed air that is introduced at point D.) Point C' is at the inlet 62 for liquid air.

Typically, the Point F is at a vapour phase mole fraction of oxygen of about 0.45 (i.e. about 45% by volume) and the Point D is at a vapour phase mole fraction of oxygen of about 0.25 (i.e. about 25% by volume). In comparable conventional air separation process which do not employ an intermediate pressure rectification column, there is instead of Points D and E a single pinch typically at a vapour phase mole fraction of oxygen of about 0.35 (i.e. about 35% by volume). As a result, the slope of the operating line below the single pinch is not as great with the result that less vapour can be fed to the side column. Accordingly, the apparatus shown in FIG. 1 makes possible an increased liquid/vapour ratio in the region EF with the advantages mentioned hereinabove. At the same time, operation of the condenser associated with the top of the intermediate rectification column increases the amount of reflux that is available to the region CC'D of the operating line. Accordingly, for example, the method according to the invention permits exceptional flexibility in the taking of liquid products from the column system while still obtaining good argon recovery.

In a first specific example of operation of a plant of the kind described above with reference to FIGS. 1 to 3, gaseous oxygen is produced at a rate of 22,000 $Nm^3$/hr, the recovery of oxygen being over 99% and the argon recovery being 94–8%. Notwithstanding these high recoveries, liquid nitrogen is taken at approximately 7,500 $Nm^3$/hr. Such a combination of production rates and recoveries is not possible from a comparable conventional plant which does not include an intermediate pressure rectification column or from a comparable plant in which the reboiler associated with the intermediate pressure rectification column is heated by nitrogen.

In a second specific example of operation of a plant of a kind described above with reference to FIGS. 1 to 3, a gaseous oxygen product is produced at a rate of 22,000 $Nm^3$/hr, a medium pressure gaseous nitrogen product is taken from the higher pressure rectification column 4 at a rate of 9,000 $Nm^3$/hr, a liquid nitrogen product is taken at a rate of 1,200 $Nm^3$/hr, and vaporous feed air is fed directly from an expansion turbine into the lower pressure rectification column 6 at a rate of 14,000 $Nm^3$/hr. (By employing the expansion turbine to perform useful work, e.g. in the driving of a compressor which compresses feed air, the total power consumption of the plant may be reduced.) The oxygen recovery is 98.9% and the argon recovery is 57%. These are substantially higher recoveries than those which can be achieved when a conventional plant, or a plant in which the reboiler associated with the intermediate pressure rectification column is heated by nitrogen, is operated with the same flow rates.

Various changes and modifications to the method and apparatus shown in FIG. 1 may be made. For example, the reboiler-condenser 8 could be of the downflow rather than the thermosiphon kind. Similarly, the condensers 30 and 50 instead of being of a straight-through or downflow reboiler kind may be of a thermosiphon kind. In another example, the second flow of the further-enriched liquid and the intermediate stream of liquid air (withdrawn from the outlet 42 of the intermediate pressure rectification column 24) are separately vaporised in the second condenser 30 and the resulting vapour streams mixed to form the second oxygen-enriched vapour. In further examples, instead of withdrawing an intermediate stream of liquid air from the outlet 42, a stream of liquid feed air, or a stream of liquid typically containing from 15 to 30% by volume of oxygen is withdrawn from the lower pressure rectification column or the higher pressure rectification column, and is mixed with the second flow of the further-enriched liquid air.

We claim:

1. A method of separating air comprising:

separating in a double rectification column, comprising a higher pressure rectification column and a lower pressure rectification column, a flow of compressed vaporous feed air into an oxygen-rich fraction and a nitrogen-rich fraction;

separating in a side rectification column a vaporous argon fraction from an argon-containing oxygen vapour stream withdrawn from a first intermediate region of the lower pressure rectification column;

taking a first oxygen-enriched liquid air stream from the double rectification column and separating said first oxygen-enriched liquid air stream in an intermediate pressure rectification column at pressures between the lowest pressure that obtains in the higher pressure rectification column and the highest pressure that obtains in the lower pressure rectification column, thereby to form a bottom liquid air fraction enriched in oxygen and a top vapour depleted of oxygen;

condensing a flow of the vaporous argon fraction in heat exchange with a second oxygen-enriched liquid air stream, thereby to form a first oxygen-enriched vapour;

condensing a flow of the oxygen-depleted vapour in heat exchange with at least one third liquid air stream, at least one of which is oxygen-enriched, thereby to form a second oxygen-enriched vapour;

introducing a stream of the first oxygen-enriched vapour into one of a second and a third intermediate region of the lower pressure rectification column;

introducing a stream of the second oxygen-enriched vapour into the other of the second and third intermediate region of the lower pressure rectification column, the second intermediate region having a higher mole fraction of oxygen in the vapour phase than the third intermediate region but a lower mole fraction of oxygen in the vapour phase than the first intermediate region;

reboiling the intermediate pressure rectification column by vapour withdrawn from one or both of the side rectification column and a section of the lower pressure rectification column extending from first intermediate region to the second intermediate region thereof;

the mean oxygen mole fraction of the said third liquid air stream being different from the oxygen mole fraction of the second oxygen-enriched liquid air stream; and taking at least some of the said third liquid air stream from one of the bottom oxygen-enriched liquid air fraction, a liquid air feed, the higher pressure rectification column, and the lower pressure rectification column.

2. The method as claimed in claim 1, in which the mole fraction of oxygen in the second oxygen-enriched liquid air stream is higher than the mean oxygen mole fraction of the said third liquid air stream, the first oxygen-enriched vapour flows to the second intermediate region of the lower pressure rectification column, and the second oxygen-enriched vapour flows to the third intermediate region of the lower pressure rectification column.

3. The method as claimed in claim 1, in which the second stream of oxygen-enriched liquid air comprises a first flow of the bottom oxygen-enriched liquid air fraction.

4. The method as claimed in claim 3, in which the said third stream of oxygen-enriched liquid air comprises a single stream of oxygen-enriched liquid air.

5. The method as claimed in claim 3, in which the said third stream of oxygen-enriched liquid air comprises a mixture of a second flow of the bottom oxygen-enriched liquid air fraction and a stream of an intermediate liquid fraction withdrawn from an intermediate region of the intermediate pressure rectification column.

6. The method as claimed in claim 5, in which a stream of liquid air is introduced into the intermediate region of the intermediate pressure rectification column.

7. The method as claimed in claim 1, in which a stream of the condensed oxygen-depleted vapour is introduced into the lower pressure rectification column.

8. The method as claimed in claim 1, in which the vapour employed to reboil the intermediate pressure rectification column is withdrawn from an intermediate region of the side rectification column.

9. The method as claimed in claim 1, in which the vapour stream is employed to reboil the intermediate pressure rectification column is, downstream of the reboiling, returned in condensed state to the region from which it is taken.

10. The method as claimed in claim 1, in which a flow of liquid feed air is introduced into any or all of the higher pressure, lower pressure and intermediate pressure rectification columns.

11. The method as claimed in claim 1, in which a part of the vaporous feed air is expanded and introduced into the lower pressure rectification column at a fourth intermediate region thereof where the oxygen concentration is lower than in the third intermediate region.

12. The method as claimed in claim 1, in which a part of the vaporous feed air is expanded and introduced into the lower pressure rectification at the third intermediate region.

13. An apparatus for separating air comprising:

a double rectification column, which itself comprises a higher pressure rectification column and a lower pressure rectification column, for separating a flow of compressed vaporous feed air into an oxygen-rich fraction and a nitrogen-rich fraction;

a side rectification column for separating an argon fraction from an argon-containing oxygen vapour stream withdrawn through an intermediate outlet from a first intermediate region of the lower pressure rectification column; the double rectification column having an outlet for a stream of a first liquid air fraction enriched in oxygen;

an intermediate pressure rectification column for separating a stream of the first oxygen-enriched liquid air fraction at pressures between a lowest pressure obtained in the the higher pressure rectification column and a highest pressure obtained in the lower pressure rectification column, thereby to produce a bottom liquid air fraction enriched in oxygen and a vapour depleted of oxygen;

a first condenser for condensing argon vapour separated in the side rectification column, the first condenser having vaporising passages communicating with a source of a second oxygen-enriched liquid air stream and with one of a second intermediate region and a third intermediate region of the lower pressure rectification column, the mole fraction of oxygen in the vapour phase in the second intermediate region being greater than the mole fraction of oxygen in the vapour phase in the third intermediate region but less than the mole fraction of oxygen in the vapour phase in the first intermediate region;

a second condenser for condensing a flow of the oxygen-depleted vapour having vaporising passages communicating with at least one source of at least one third liquid air stream and with the other of the second intermediate region and the third intermediate region, at least one said source being oxygen-enriched so that the mean oxygen mole fraction of the said liquid air stream is different from the mole fraction of oxygen of the second liquid air stream enriched in oxygen; and a reboiler associated with the intermediate pressure rectification column having condensing passages communicating with an outlet from a section of the lower pressure rectification column extending from at least one of said first intermediate region to said second intermediate region and an outlet from the side rectification column;

the said source of the third liquid air stream comprising at least one of a bottom region of the intermediate pressure rectification column where, in use, the bottom oxygen-enriched liquid air fraction collects, the higher pressure rectification column, the lower pressure rectification column, and a source of liquefied feed air.

14. The apparatus as claimed in claim 13, in which the source of the second oxygen-enriched liquid air stream is a bottom region of the intermediate pressure rectification column, where, in use, the bottom oxygen-enriched liquid air fraction collects.

15. The apparatus as claimed in claim 13, wherein there are two sources of the third liquid air stream, one being an intermediate region of the intermediate pressure rectification column, and the other being the bottom region of the intermediate pressure rectification column.

16. The apparatus as claimed in claim 13, additionally including an inlet to at least one of the higher pressure rectification column, the lower pressure rectification column, and the intermediate pressure rectification column for a liquid feed air stream.

17. The apparatus as claimed in claim 13, additionally including an outlet from the higher pressure rectification column for a product nitrogen stream.

18. The apparatus as claimed in claim 13, additionally including a pump for withdrawing oxygen product stream in liquid state from the lower pressure rectification column.

* * * * *